United States Patent [19]

Eastman

[11] 4,082,575

[45] Apr. 4, 1978

[54] PRODUCTION OF LIQUID COMPATIBLE METALS

[75] Inventor: George Y. Eastman, Lancaster, Pa.

[73] Assignee: Thermacore, Inc., Leola, Pa.

[21] Appl. No.: 679,038

[22] Filed: Apr. 21, 1976

[51] Int. Cl.[2] ..... C23F 7/04

[52] U.S. Cl. ..... 148/6.35; 148/31.5; 29/157.3 H; 165/133; 148/16.6

[58] Field of Search ..... 148/6.35, 6.3, 16.6; 29/157 R, 157.3 R, 157.3 H; 165/106, 133

[56] References Cited

U.S. PATENT DOCUMENTS

| | | | |
|---|---|---|---|
| 2,127,388 | 8/1938 | Canfield et al. | 148/6.15 R |
| 2,269,601 | 1/1942 | Perrin | 148/6.35 |
| 2,842,458 | 7/1958 | Feeney et al. | 427/376 D |
| 3,259,526 | 7/1966 | Walker et al. | 148/6.35 |
| 3,377,213 | 4/1968 | Hiller | 148/6.35 |
| 3,573,996 | 4/1971 | Wimber et al. | 148/6.3 |
| 3,660,173 | 5/1972 | Matsuno et al. | 148/6.3 |
| 3,705,057 | 12/1972 | Kelp | 148/6.35 |
| 3,730,779 | 5/1973 | Caule et al. | 148/6.35 |

OTHER PUBLICATIONS

Nitralloy and the Nitriding Process, the Nitralloy Corp., N.Y., N.Y., 1943, pp. 2, 13, 15, 16, 25, 30.

*Primary Examiner*—Ralph S. Kendall
*Attorney, Agent, or Firm*—Martin Fruitman

[57] ABSTRACT

A process for producing liquid compatible metals and a heat pipe manufactured by that process. One example of the process comprises the formation of an aluminum oxide surface layer on an aluminum bearing steel alloy by heating the steel to a high temperature in an oxidizing environment.

4 Claims, No Drawings

PRODUCTION OF LIQUID COMPATIBLE METALS

BACKGROUND OF THE INVENTION

The present invention relates to a process for the production of liquid compatible metals. It specifically relates to the production of a surface coated metal which is suitable for use in a heat pipe using a liquid which would normally degrade the base metal. When used in a heat pipe, the resulting metal does not exhibit any deterioration even with long term operation, because of the surface coating.

Liquid compatibility of materials, particularly as related to heat pipe operation, is basically the characteristic of being completely inert to the liquid and in addition being wetted by it. The inert nature of a material is stringently tested during long life operation in a heat pipe. In that application, solubility will cause removal of the material and eventual leaks in the casing, while any chemical activity will form gaseous by-products which quickly block operation of the heat transfer cycle and cause a complete malfunction of the heat pipe. For example, the austenitic stainless steels designated as AISI 300-series in conventional use are generally regarded as fully compatible with water, the term "compatible" implying a lack of solution or corrosive chemical attack of the steel by water. When used in a heat pipe, water has been shown to react with these same stainless steels, resulting in the formation of complex solid hydroxides and the liberation of hydrogen gas. The gas then acts to block proper vapor flow in the heat pipe. The solid hydroxides may clog the pores in the wick structure. Both effects are deleterious. The action is sufficiently rapid as to liberate enough hydrogen to affect heat pipe operation measurably within a few hours after operation is started. These effects are well known to practitioners of the heat pipe art and are described in reports of contracts let by the National Science Foundation. Effects similar to those cited here for stainless steels have also been reported with nickel and low carbon steel and with fluids such as alcohols, esters and ketones.

Although water is highly desirable as a thermodynamic working fluid, its use in heat pipes has been limited because compatibility has been found in glass, copper and certain ceramic materials, including aluminum oxide. While copper can and is being used as a heat pipe material with water fluid, such devices are limited in their application due to the low strength, the relative chemical activity and high thermal expansion of copper. Copper can not, for instance, be used with an external environment such as a natural gas flame due to excessive corrosion by the combustion gases. Glass heat pipes have also been made on an experimental basis, but the inherent weakness and brittleness of the material makes its use impractical. Ceramic heat pipes have not proved practical due to high cost and the difficulty of sealing them.

It is highly desirable to use steels in heat pipe casings because of their low cost, strength, ease of forming, corrosion resistance and compatibility with other materials of construction.

It is, therefore, an object of the present invention to provide metals which are compatible with various liquids including water and a method for preparing such metals so that they have the basic characteristics of the base metal, but are inert to any action by the liquid in contact with the metal.

It is a further object of the present invention to provide heat pipes made from such liquid-compatible metals and a method for producing such heat pipes.

It is a still further object of this invention to provide a process to produce steel heat pipes for use with water which produce no perceptible gaseous or solid by-products that can hinder the long time operation of the heat pipes.

It is an additional object of this invention to provide a method of producing metals and heat pipes which are compatible with other working fluids of the group esters, ketones, alcohols, ammonia, benzene, and their derivatives. Examples of these working fluids are: acetone, methanol, ethanol, ethylene glycol, ammonia and benzene.

It is an additional objective of this invention to produce liquid compatible heat pipes made from steels having as alloying agents materials readily forming adherent liquid compatible surface layers. These alloying materials are drawn from the group aluminum, beryllium, magnesium, titanium, hafnium, zirconium, silicon, calcium, chromium and copper.

SUMMARY OF THE INVENTION

These and other objects may be obtained by the use of the invention herein described wherein the metal is first formed into the finished object and then processed by simple and inexpensive steps, to attain the desired characteristic of liquid compatibility. The process consists first of selecting a base structural metal which contains a metal which will form stable compounds with a gas, of which oxygen and nitrogen are examples, either from the major constituent metal itself or from one of the metals used in forming an alloy with the major constituent. The compounds formed, examples of which are oxides and nitrides, must be among those which are themselves compatible with the selected working liquid. The compounds must be strongly adherent to the base metal and have a thermal expansion rate sufficiently similar to that of the base metal to prevent cracking or spalling during thermal cycling. These properties are well known to those familiar with the techniques of enameling and the sealing of metals to ceramics. Once the appropriate metal is selected, the metal is worked into its final form, and then the metal is thoroughly cleaned to assure that any compounds later formed on the surface of the formed object are pure and well bonded to the surface. Finally, the object is heated to a high temperature, one sufficient to form stable compounds readily with the constituents of a gaseous atmosphere. The atmosphere is so selected that at least one of its constituents forms a desired stable compound with at least one of the component elements of the metal alloy. The heating step is, in a sense, automatically selective. If, for example, the atmosphere is air, with the dominant presence of nitrogen and oxygen, an alloy is selected which contains component elements which form stable compounds of those elements. Moreover, any particular metal will only form and retain those compounds which are most stable for it, so that the metal itself will determine which compounds are formed, and only the most stable compounds will remain after the heating cycle. The time at which the work is kept at temperature can be varied to control the thickness of the surface compound.

An important part of the inherent action of the heat cycle is the diffusion of alloy materials to the surface of the metal when the metal is subject to temperatures greater than about 500° C. This assures a continuous supply of the active alloy materials near the surface and permits the formation of deeper and more perfect surface compounds of materials other than the basic metal of the alloy. It is this continuous layer of insoluble surface compounds which prevents reaction between the fluid and the underlying material of the metal alloy. The continuous layer renders the surface inert and establishes compatibility between the liquid and the underlying metal.

DESCRIPTION OF THE PREFERRED EMBODIMENT

The embodiment selected for description is the process for preparing a steel alloy compatible with water. As noted previously, such a combination is normally not compatible and, for instance, a heat pipe made of steel will operate only a very short time before hydrogen gas produced by the chemical reaction between the steel and the water blocks operation of the heat exchange cycle. Since such malfunction occurs with very small quantities of released gas, the heat pipe application is considered to be an extreme test of compatibility. The process of this invention is therefore particularly suited for the production of heat pipes.

For this embodiment, the casing of the heat pipe is first constructed of an aluminum bearing steel. One alloy successfully used is designated 18 SR, manufactured by Armco Steel Corporation. This material is covered by U.S. Pat. No. 3,759,705 and contains 1.6 to 2.7 percent of aluminum. It will be recognized, however, that other similar alloys will perform as well, such as Inconel 601 manufactured by International Nickel Co. and Kanthal A-1 manufactured by The Kanthal Corporation. The casing is fabricated by conventional metal forming techniques into the appropriate shape. Once formed, the casing is thoroughly cleaned to assure that no grease or other contaminates are present on the surface to prevent formation of a uniform adherent oxide coating.

This cleaning can be easily accomplished by ultrasonic washing in water with a small quantity of detergent followed by immersion and scrubbing in trichloroethylene and drying in clean air. After the cleaning process, the metal should be handled only with the use of clean gloves to avoid re-contamination of the surface by oils from the skin. It is also practical, depending on the specific contaminates on the surface, for this cleaning step to be automatically accomplished by the heating of the following procedure.

The aluminum present in 18 SR steel is then diffused to the surface and oxidized by heating the casing in clean air in a furnace at 700° C for one hour. This produces a continuous, adherent coat of aluminum oxide approximately one micron thick which is impervious to the action of water. The aluminum oxide and the underlying steel have similar rates of thermal expansion, which prevents the generation of excessive stresses during thermal cycling. The construction of the heat pipe is then completed in a conventional manner by inserting a wick element, adding the appropriate amount of distilled water, pumping the air from the heat pipe, and sealing off the heat pipe. These final procedures are well established in the field and are known to those skilled in the art of heat pipes.

A heat pipe made by the above described method is free of any evidence of gas generation or chemical reaction between the steel casing and water and has an operating life surpassing 9000 hours including more than 2,900 thermal cycles with no sign of deterioration.

It is to be understood that the heating time and temperature required to cause diffusion to the surface of alloying metals prior to oxidation are strongly related and highly dependent upon the materials involved. A lower temperature will require a longer time. Nevertheless, experience in the field of metal technology is well documented and those skilled in the art of heat treating of metals will be capable of selecting temperatures at which the desired diffusion and surface compound formation will proceed in reasonable lengths of time. The percentage of alloying material available in the base metal will affect the diffusion time and continuity of the resulting surface coating. The method described here requires a ratio of more than one-half percent alloying material to assure a finished part with complete continuity of surface coat and while high concentrations of alloying material, surpassing 5 per cent, will still permit proper surface coating, such high concentrations make forming operations and welding more difficult and are generally avoided.

Another example of an embodiment using different metals involves the use of titanium as an alloying material in a nickel-based superalloy such as Inconel X-750. When such an alloy is heated at 600°–725° C in air, the protective coating which will form is titanium oxide. This compound, like the aluminum oxide coating of the first embodiment described, will yield protection not only against the action of water, but also against many other heat pipe working fluids, such as acetone, methanol, ethanol, ethylene glycol, benzene and various derivatives of these materials. An alternative lies in heating this same alloy in a pure nitrogen atmosphere at 600°–1000° C. The surface layer then formed will consist of titanium nitride which is similarly adherent and protective against fluid attack.

It is to be understood that the forms of the invention herein shown are merely preferred embodiments. Various changes may be made in materials, temperatures and times of processing; equivalent means may be substituted for those described; and certain steps may be used independently from others without departing from the spirit and scope of the invention. For example, different cleaning methods can be used prior to heating, or the cleaning step may be eliminated completely if the material used is received in clean condition or the contaminates are volatile enough to be cleaned by the heating process itself. Moreover, other alloy metals can be used. Zirconium could, for instance, be substituted for the titanium of the second embodiment described and any of the non-ferrous metals such as magnesium, calcium, beryllium, titanium, zirconium, hafnium, chromium and copper can be substituted for the aluminum in the first embodiment described, although compatibility with all fluids will not be assured with all of these alloying materials. For example, magnesium, calcium and beryllium oxides are not fully compatible with water.

What is claimed as new and desired to be secured by Letters Patent of the United States is:

1. A method of making a water compatible steel heat pipe which comprises:

selecting a steel with a thermal expansion rate sufficiently similar to that of aluminum oxide to prevent cracking and spalling of an aluminum oxide coating during thermal cycling and containing between one-half and five percent aluminum as an alloying metal;

performing all required forming operations to shape said steel into the casing of a heat pipe;

heating said casing within an environment of clean, dry air to a temperature of between 500° to 1000° Centigrade for between one and ten hours, diffusing the aluminum alloying metal to the surface of said casing and causing a chemical reaction to occur between the aluminum and the oxygen of the air to form a continuous adherent water compatible surface coating of aluminum oxide of approximately one micron depth; and using said surface coated casing as a component of a heat pipe assembled by conventional methods.

2. A method of making a water compatible heat pipe from steel as in claim 1 which comprises the additional step of cleaning said casing of the heat pipe immediately prior to the heating step.

3. A water-compatible steel part for a heat pipe which has a surface coating of aluminum oxide produced by heating the part formed from steel containing between one half and five percent aluminum in a clean, dry air atmosphere to a temperature of between 500 and 1000 degrees Centigrade for a time sufficient to oxidize the aluminum into a continuous surface coating of approximately one micron depth which protects the steel from the effects of contact with the water.

4. A water-compatible steel sealed casing which remains imperious and chemically inert despite repeated extreme thermal cycling which has a surface coating of aluminum oxide produced by heating the part formed from steel containing between one half and five percent aluminum in a clean, dry air atmosphere to a temperature of between 500 and 1000 degrees Centigrade for a time sufficient to oxidize the aluminum into a continuous surface coating of approximately one micron depth which protects the steel from the effects of contact with the water.

* * * * *